United States Patent [19]

Sato et al.

[11] 4,057,430

[45] Nov. 8, 1977

[54] SILVER HALIDE PHOTOGRAPHIC EMULSION

[75] Inventors: Akira Sato; Akira Ogawa; Masanao Hinata; Haruo Takei, all of Minami-ashigara, Japan

[73] Assignee: Fuji Photo Film Co., Ltd., Minami-ashigara, Japan

[21] Appl. No.: 656,685

[22] Filed: Feb. 9, 1976

Related U.S. Application Data

[63] Continuation of Ser. No. 464,094, April 25, 1974, abandoned.

[30] Foreign Application Priority Data

Apr. 25, 1973 Japan ..... 48-47467

[51] Int. Cl.[2] ..... G03C 1/22

[52] U.S. Cl. ..... 96/100 R; 96/107; 96/109; 96/111; 96/114.5; 96/122; 96/140

[58] Field of Search ..... 96/140, 100, 107, 109, 96/111, 114.5, 122

[56] References Cited

U.S. PATENT DOCUMENTS

| | | | |
|---|---|---|---|
| 3,698,910 | 10/1972 | Sakazume et al. | 96/140 |
| 3,734,739 | 5/1973 | Borror | 96/140 |
| 3,736,145 | 5/1973 | Hirata et al. | 96/140 |
| 3,765,900 | 10/1973 | Depoorter et al. | 96/140 |
| 3,808,009 | 4/1974 | Sakazume et al. | 96/140 |
| 3,822,136 | 7/1974 | Sakazume et al. | 96/140 |

*Primary Examiner*—J. Travis Brown
*Attorney, Agent, or Firm*—Sughrue, Rothwell, Mion, Zinn and Macpeak

[57] ABSTRACT

A silver halide photographic emulsion containing at least one sensitizing dye represented by the following general formula (I), (I)

in which Z represents an atomic group necessary for forming a benzoxazole nucleus or a naphthoxazole nucleus; $R_1$ represents an aliphatic group; $R_2$ represents an alkyl group, an allyl group or an aryl group; $R_3$ represents an alkoxycarbonylalkyl group, an alkoxyalkyl group, an N-(N,N-dialkylaminoalkyl)carbamoylalkyl group, an N-(N,N,N-trialkylammoniumalkyl)carbamoylalkyl group or an N,N,N-trialkylammoniumalkyl group, with $R_2$ being a phenyl group where $R_3$ is an alkoxycarbonylalkyl group; X represents an acid anion; and *n* represents 0 or 1.

14 Claims, 6 Drawing Figures

SILVER HALIDE PHOTOGRAPHIC EMULSION

This is a continuation of application Ser. No. 464,094, filed Apr. 25, 1974, now abandoned.

BACKGROUND OF THE INVENTION

1. Field of the Invention

This invention relates to a silver halide emulsion spectrally sensitized with a novel mercyanine dye and particularly, it is concerned with a silver halide photographic emulsion having a high green sensitivity.

2. Description of the Prior Art

It has hitherto been known that some dimethinemerocyanine dyes can be used as a spectral sensitizer for a photographic emulsion, for example, as disclosed in U.S. Pat. Nos. 3,480,439, 2,497,876, 2,519,001 and 3,567,458. However, their sensitizing capacity is not enough.

SUMMARY OF THE INVENTION

Therefore, it is a first object of the invention to provide a silver halide photographic emulsion having a strong spectral sensitization.

It is a second object of the invention to provide a spectrally sensitized silver halide photographic emulsion, which sensitivity does not decrease very much during the passage of time from the production of a light-sensitive material.

It is another object of the invention to provide a silver halide photographic emulsion sensitized with a sensitizing dye which is free from residual color after development and which is excellent in solubility.

It has been surprisingly found that the above described objects can be accomplished with a silver halide photographic emulsion containing a merocyanine dye represented by the following general formula (I),

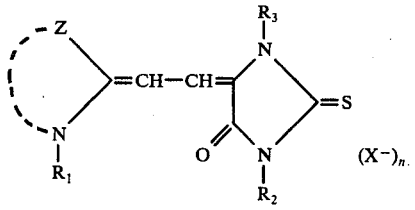

(I)

in which Z represents an atomic group necessary for forming a benzoxazole nucleus or a naphthoxazole nucleus; $R_1$ represents an aliphatic group; $R_2$ represents an alkyl group, an allyl group or an aryl group; $R_3$ represents an alkoxycarbonylalkyl group, an alkoxyalkyl group, an N-(N,N-dialkylaminoalkyl)carbamoylalkyl group, an N-(N,N,N-trialkylammoniumalkyl)carbamoylalkyl group or an N,N,N-trialkylammoniumalkyl group with $R_2$ being a phenyl group where $R_3$ is an alkoxycarbonylalkyl group; X represents an acid anion; and $n$ represents 0 or 1.

BRIEF DESCRIPTION OF THE ACCOMPANYING DRAWING

DETAILED DESCRIPTION OF THE INVENTION

Figure 1:
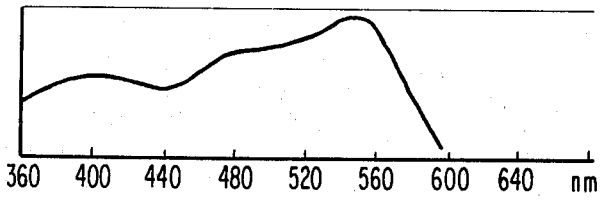
FIG. 1 to FIG. 5 shows spectral sensitivity curves of photographic emulsions obtained respectively by adding the sensitizing dyes ((6), (2), (5) and (16)) of the invention and the comparative dye to the silver chloroiodobromide used in the Example in which the abscissa is the wavelength and the ordinate is the sensitivity.

In the general formula (I), Z represents an atomic group necessary for forming a benzoxazole or naphthoxazole nucleus which can be optionally substituted with halogen atoms (e.g., F, Cl, Br), alkyl groups (e.g., those having from 1 to 8 carbon atoms, preferably from 1 to 4 carbon atoms), alkoxy groups (e.g., those having from 1 to 4 carbon atoms), alkoxycarbonyl groups (e.g., those containing an alkyl moiety having from 1 to 4 carbon atoms). Illustrative examples of these nuclei are benzoxazole; halogen-, alkyl-, alkoxy-, hydroxy-, trifluoromethyl-, alkoxycarbonyl-, acetyl- or phenyl-substituted benzoxazoles such as 5-fluorobenzoxazole, 5-chlorobenzoxazole, 5-bromobenzoxazole, 5-methylbenzoxazole, 5-methoxybenzoxazole, 5-hydroxybenzoxazole, 5-trifluoromethylbenzoxazole, 5-methoxycarbonylbenzoxazole, 5-acetylbenzoxazole, 5-phenylbenzoxazole, 6-methylbenzoxazole, 6-methoxybenzoxazole, 6-hydroxybenzoxazole, 5,6-dimethylbenzoxazole, 5-chloro-6-methylbenzoxazole; a-naphthoxazole, β,β-naphthoxazole; and β-naphthoxazole.

$R_1$ represents an aliphatic group comprising an unsubstituted or substituted alkyl group, such as an unsubstituted alkyl group (for example, methyl, ethyl, propyl, butyl) and a hydroxyalkyl substituted alkyl group, such as a hydroxyalkyl group (for example, β-hydroxyethyl, γ-hydroxypropyl, γ-hydroxypropyl), an alkoxyalkyl group (for example, β-methoxyethyl, γ-methoxypropyl), an acyloxyalkyl group (for example, β-acetoxyethyl, ω-propionyloxybutyl), a carboxyalkyl group (for example, β-carboxyethyl, ω-carboxybutyl), an alkoxycarbonylalkyl group (for example, methoxycarbonylmethyl, β-methoxycarbonylethyl, ω-ethoxycarbonylbutyl), a sulfoalkyl group (for example, β-sulfoethyl, γ-sulfopropyl δ-sulfobutyl, γ-sulfobutyl), a sulfatoalkyl group (for example, β-sulfatoethyl, ω-sulfatobutyl), an aralkyl group (for example, benzyl, phenethyl, p-carboxybenzyl, p-carboxyphenethyl, p-sulfobenzyl, p-sulfophenethyl) or an allyl group (vinylmethyl group).

$R_2$ represents an alkyl group such as a methyl, ethyl, propyl or butyl group, an allyl group such as a vinylmethyl group, or a aryl group such as a phenyl or p-sulfophenyl group.

$R_3$ represents an alkoxycarbonylalkyl group (for example, methoxycarbonylmethyl, ethoxycarbonylmethyl), an alkoxyalkyl group (for example, hydroxymethoxymethyl, 2-hydroxyethoxymethyl, 2-(2-hydroxyethoxy)ethyl, 2-(2-acetoxyethoxy)ethyl, acetoxymethoxymethyl), an N-(N,N-dialkylaminoalkyl)-carbamoylalkyl group (for example, N-(3-(N,N-dimethylamino)propyl)carbamoylmethyl, N-(2-(N,N-diethylamino)ethyl)carbamoylmethyl, N-(3-(morpholino)-propyl)carbamoylmethyl, N-(3-(piperidino)propyl)carbamoylmethyl), an N-(N,N,N-trialkylammoniumalkyl)-carbamoylalkyl group (for example, N-(3-(N,N,N-trimethylammonium)propyl)carbamoylmethyl, N-(3-(N,N,N-triethylammonium)propyl)carbamoylmethyl, N-(3-(N-methylmorpholino)-propyl)-carbamoylmethyl, N-(3-(N-methylpiperidino)propyl)carbamoylmethyl) or an N,N,N-trialkylammoniumalkyl group (for example, N,N-diethyl-N-methylammoniumethyl, N,N,N-triethylammoniumethyl), where $R_3$ is an alkoxycarbonyl group, $R_2$ represents a phenyl group.

X represents an acid anion such as a chloride, bromide, iodide, p-toluenesulfonate, methylsulfate or ethylsulfate ion and

*n* represents 0 or 1.

Illustrative examples of the new merocyanine dye used in the present invention are given in the following. However, the invention is not to be construed as being limited to these specific examples only:

(1) $\lambda_{max}^{MeOH}$ 490 mμ

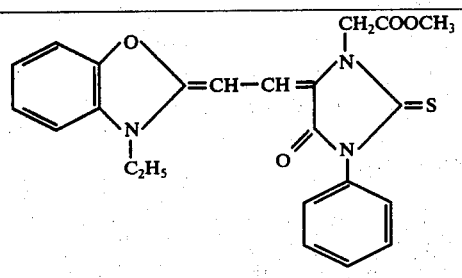

(2) 489 mμ

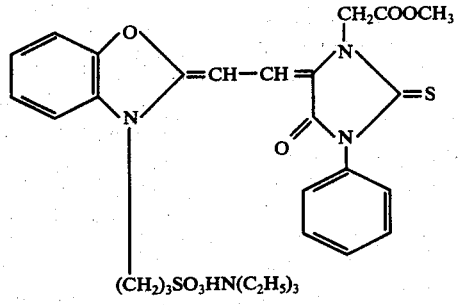

(3) 492 mμ

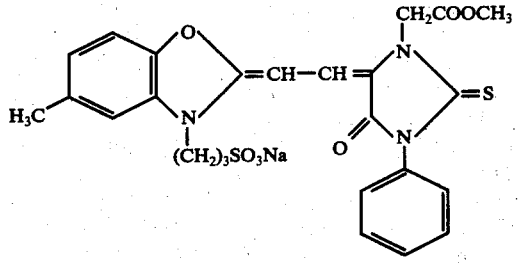

(4) 492 mμ

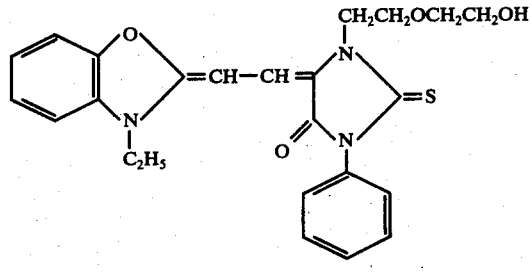

(5) 491 mμ

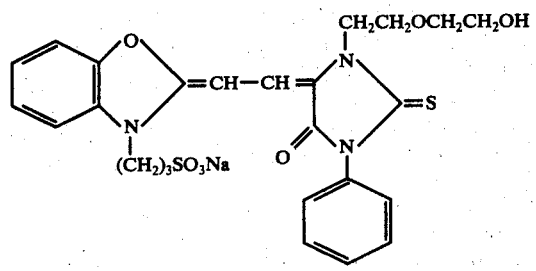

(6) 497 mμ

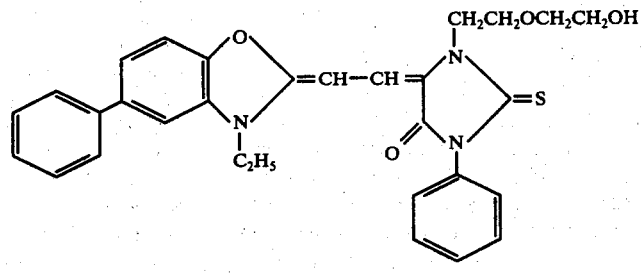

-continued
(7) 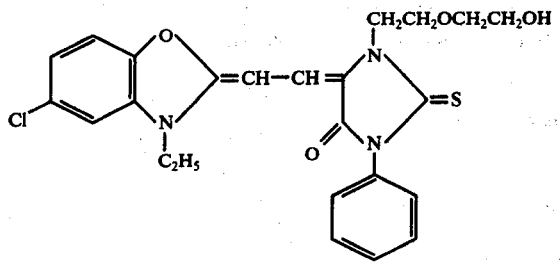
490 mμ
(8) 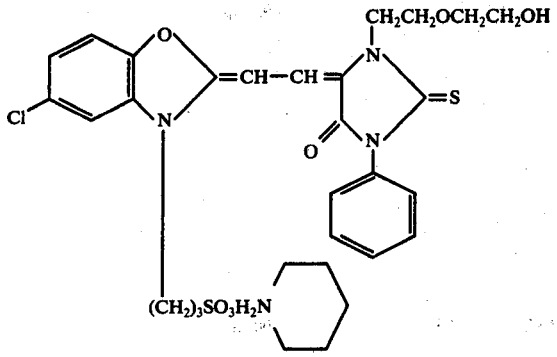
488 mμ
(9) 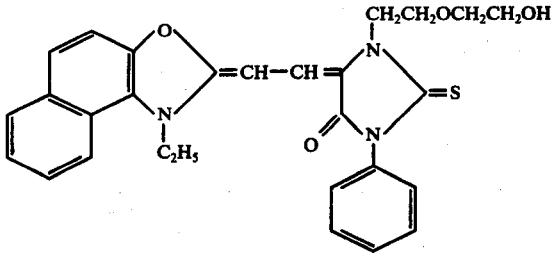
509 mμ
(10) 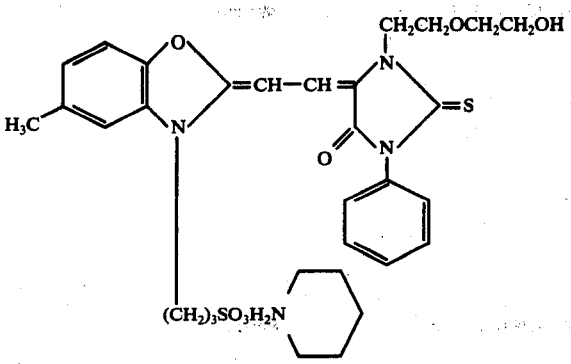
494 mμ
(11) 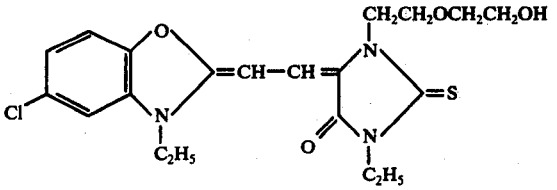
486 mμ
(12) 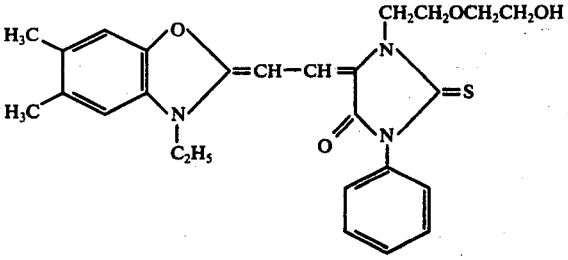
500 mμ

-continued
(13) 487 mμ
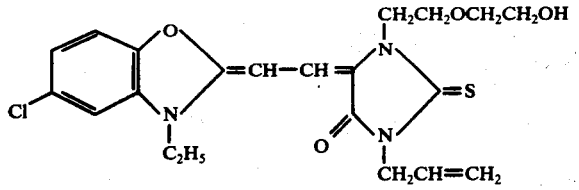
(14) 493 mμ
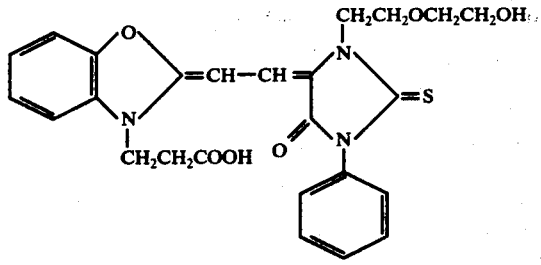
(15) 490 mμ
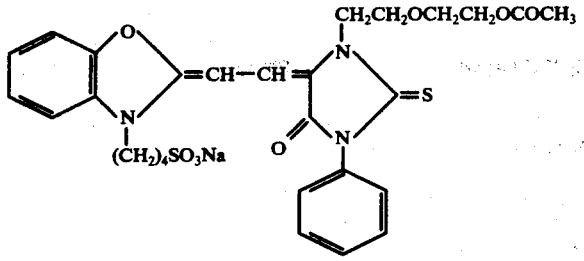
(16) 488 mμ
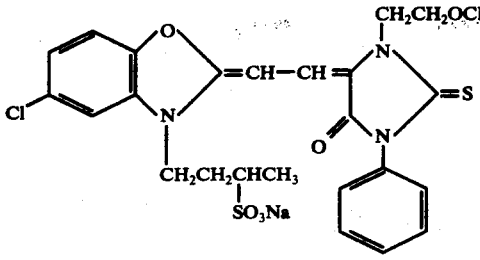
(17) 488 mμ
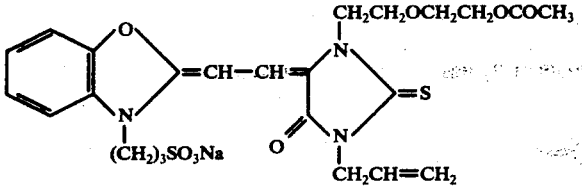
(18) 490 mμ
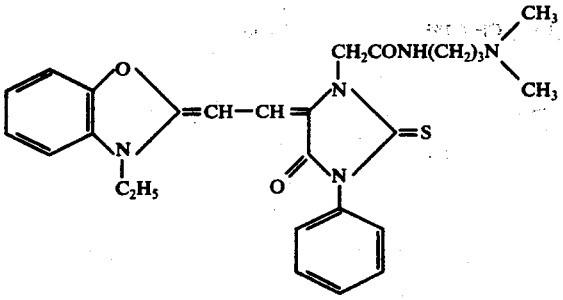

-continued
(19) 492 mμ
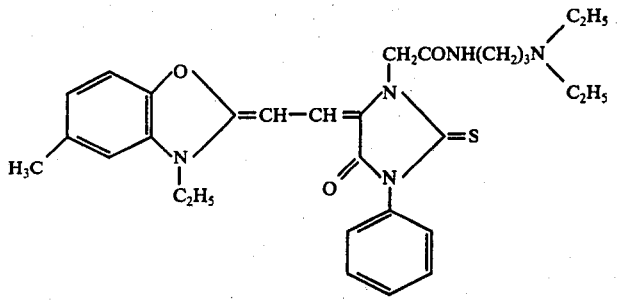
(20) 489 mμ
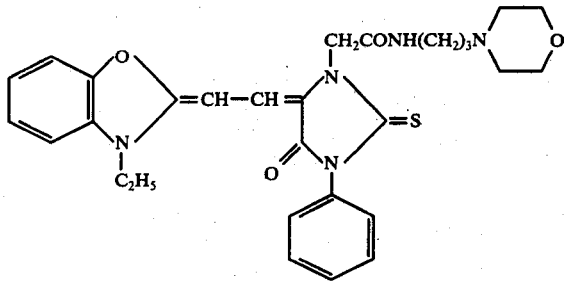
(21) 480 mμ
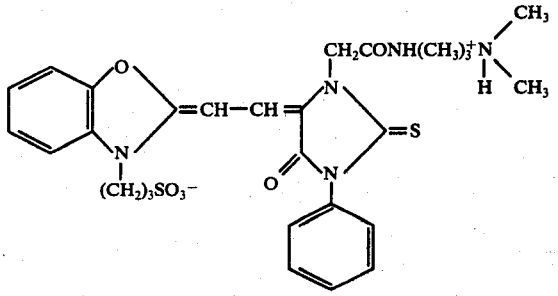
(22) 480 mμ
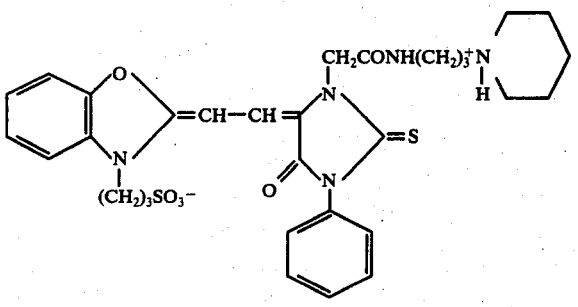
(23) 491 mμ
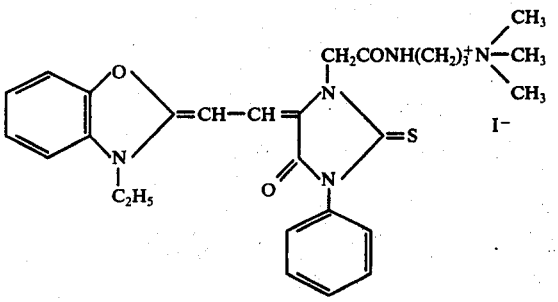
(24)
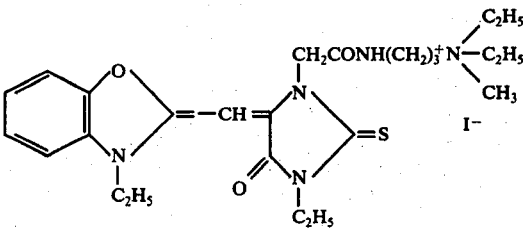

-continued (25)

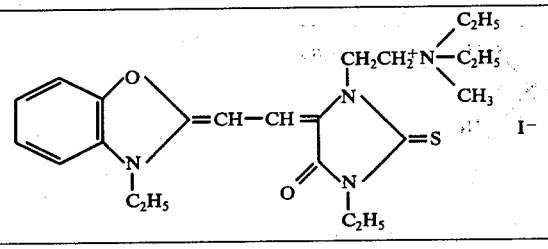

The novel merocyanine dye of the invention is capable of super-sensitizing (super-additive marked increase in sensitivity) an emulsion in combination with a dye disclosed in the patent specifications, for example, U.S. Pat. Nos. 3,617,294; 3,667,960; 3,745,014; 3,628,964; 3,615,635; 2,527,641; 3,522,052 and 3,617,293, U.S. Ser. No. 354,421, filed Apr. 25, 1973 and Belg. Pat. No. 691,807.

Examples of the synthesis of the compound of the invention are as follows:

Synthetic Example 1

Synthesis of Compound (4)

100 g of 2-(2-aminoethoxy)ethanol was added to 200 ml of ethyl acetate, to which a solution of 160 g of bromoacetic acid ethyl ester in 100 ml of ethyl acetate was dropwise added with agitation and with cooling to about 10° - 15° C with water. After 1 hour, the product was washed with diethyl ether, dissolved in 100 ml of water, mixed with a solution of 80 g of phenyl isothiocyanate in 300 ml of ethanol and reacted with refluxing for 3 hours. Then the ethanol was distilled off under reduced pressure and 1000 ml of water was added. The precipitated oily material was extracted with chloroform, dried, the chloroform was distilled off and the crystals were removed by filtration, followed by recrystallization from ethanol to obtain 35 g of 1(2-hydroxyethoxy)ethyl-3-phenyl-2-thiohydantoin melting at 85°-87° C.

To 4.0 g of 1-(2-hydroxyethoxy)ethyl-3-phenyl-2-thiohydantoin and 6.2 g of 2-acetanilidevinyl-3-ethylbenzoxazolium iodide were added 50 ml of ethyl alcohol and 4 ml of triethylamine, reacted with refluxing for 30 minutes, allowed to stand and the precipitated crystals were removed by filtration, followed by recrystallization from a 1:1 (by volume) mixed solution of methyl alcohol and chloroform to obtain 3.2 g of Compound (4) of a red-orange color.

Synthetic Example 2

Synthesis of Compound (5)

To 4.0 g of 1-(2-hydroxyethoxy)ethyl-3-phenyl-2-thiohydantoin and 5.1 g of anhydro-2-anilidevinyl-33-sulfo)propylbenozazolium hydroxide were added 100 ml of pyridine and 8 ml of piperidine and reacted with refluxing for 1 hour on an oil bath. After cooling, diethyl ethyl was added to precipitate a dye, which was then washed three times with 500 ml of diethyl ether each time. This was dissolved in ethanol and a solution of sodium iodide in methyl alcohol was added to crystallize a dye, which was then subjected to filtration to obtain 4.5 g of a crude dye. This crude dye was recrystallized twice from a 1:1 (by volume) mixed solution of methyl alcohol and chloroform, thus obtaining 2.5 g of Compound (5) of a red-orange color.

Synthetic Example 3

Synthesis of Compound (18)

2.9 g of 2-methoxycarbonylmethyl-3-phenylhydantoin and 1.5 g of N,N-dimethylaminopropylamine were heated and reacted under melting at 130° C for 3 hours on an oil bath. After cooling, the product was washed with diethyl ether, mixed with 4 g of 2-acetanilidevinyl-3-ethylbenzoxazolium iodide, 50 ml of ethyl alcohol and 2 ml of triethylamine and then reacted with refluxing for 30 minutes. The precipitated crystals were removed by filtration and recrystallized from a 1:1 (by volume) mixed solution of ethyl alcohol and chloroform, thus obtaining 2.1 g of Compound (18).

Synthetic Example 4

Synthesis of Compound (23)

0.2 g of Compound (18) was dissolved in 20 ml of benzene, mixed with 0.8 ml of methyl iodide and warmed to a temperature of 60°-70° C and reacted for 10 minutes on a warm water bath. The thus precipitated crystals were removed by filtration and washed with benzene to obtain 0.1 g of Compound (23).

The new merocyanine dye of the invention can be used for not only light-sensitive materials for black-and-white photography but also multi-layer light-sensitive materials for color photography, since the sensitization achieved using the merocyanine dye of the present invention is not deteriorated by the presence of a color coupler and the merocyanine dye of the present invention does not sensitize adjacent layers by diffusion into these adjacent layers.

The merocyanine dye of the invention is, in particular, excellent in increasing the green sensitivity of a lithographic emulsion and in adaptability to lithographic development, and also suitable for the spectral sensitization of a microphotographic emulsion. The spectral sensitizing technique according to the invention is available for light-sensitive emulsions of the ortho-type as well as light-sensitive emulsions for multilayer internal type color photography.

The silver halide photographic emulsion used in the invention can contain grains of silver chloride, silver bromide, silver iodide or mixed silver halides such as silver chlorobromide, silver bromoiodide, silver chlorobromoiodide or silver chloroiodide precipitated and ripened in a conventional manner, for example, by the single jet method or by the double jet method or by using a combined method thereof. A preferred silver halide is silver chlorobromide or silver chloroiodobromide. The average diameter of the grains (e.g., as measured by the projected area method) is preferably about 0.04 to 2 microns. The silver halide photographic emulsion which can be used in the invention can be subjected to conventionally used chemical sensitizing methods, for example, gold sensitization (as disclosed in U.S. Pat. Nos. 2,540,085, 2,597,856, 2,597,915 and 2,399,083), Group VIII metal ion sensitization, sulfur sensitization (as disclosed in U.S. Pat. Nos. 1,574,944, 2,278,947, 2,440,206, 2,410,689, 3,189,458 and 3,415,649), reduction sensitization (as disclosed in U.S. Pat. Nos. 2,518,698, 2,419,974 and 2,983,610) or a combination of these sensitization methods.

Illustrative chemical sensitizers are, for example, sulfur sensitizers such as allylthiocarbamide, thiourea, sodium thiosulfate and cystine, noble metal sensitizers such as potassium chloroaurate, aurous thiosulfate and potassium chloropalladate and reduction sensitizers such as stannous chloride, phenylhydrazine and reductone. Furthermore, other sensitizers such as polyoxyethylene derivatives, polyoxypropylene derivatives and derivatives with quaternary ammonium groups can be used. In the emulsion of the invention can be incorporated an antifoggant (such as nitrobenzimidazole or ammonium chloroplatinate) and a stabilizer (such as 4-hydroxy-6-methyl-1,3,3a,7-tetrazaindene). Suitable examples of antifoggants and stabilizers are disclosed in U.S. Pat. Nos., e.g., 2,444,605, 2,444,606, 2,444,607, 2,444,608, 1,758,576, 2,476,536, 2,995,444, 3,053,544, 2,886,437, 2,403,927, 2,839,405, 3,220,839, 2,566,263 and 2,597,915. Moreover, a hardener such as formaldehyde, chloroform, 1-hydroxy-3,5-dichlorotriazine sodium salt, glyoxal or dichloroacrolein and a coating aid such as saponin or sodium alkylbenzenesulfonate can be employed. Suitable examples of hardeners are disclosed in U.S. Pat. Nos. 3,288,775, 2,732,303, 3,635,718, 3,232,763, 2,732,316 and 2,586,168. Suitable examples of coating aids are disclosed in U.S. Pat. Nos. 2,271,623, 3,415,649, 2,823,123, 2,600,831, 3,133,816, 2,240,472, 2,288,226, 2,739,891, 3,068,101, 3,158,484, 3,201,253, 3,210,191, 3,294,540, 3,415,649, 3,441,413, 3,442,654, 3,475,174 and 3,545,974.

The silver halide emulsion used in the invention contains a color coupler and dispersing agent thereof when used for light-sensitive materials for color photography.

The silver halide photographic emulsion used in the invention can contain, as a protective colloid, gelatin and gelatin derivatives such as phthalated gelatin and malonated gelatin, cellulose derivatives such as hydroxyethyl cellulose and carboxymethyl cellulose, soluble starches such as dextrin and hydrophilic polymers such as polyvinyl alcohol, polyvinylpyrrolidone, polyacrylamide and polysytrenesulfonic cid, a plasticizer for size stabilization, a latex polymer and a matting agent. Suitable examples of hydrophilic colloids are disclosed, for example, in U.S. Pat. Nos. 3,142,568, 3,193,386, 3,062,674, 3,220,844, 3,287,289 and 3,411,911. The finished emulsion can be coated onto a suitable support, for example, baryta paper, resincoated paper, synthetic paper, triacetate film, polyethylene terephthalate film, glass sheet or other plastic bases. The sensitizing dye used in the invention is added in the form of an aqueous solution or a solution in a water-miscible organic solvent such as methyl alcohol, ethyl alcohol, methyl cellosolve or pyridine. The amount added is that conventionally used amount sufficient for spectral sensitization, for example, about $5 \times 10^{-3}$ mol to $1 \times 10^{-6}$ mol of a sensitizing dye per 1 mol of silver. A suitable coating amount of the silver halide preferably ranges from about 20 to 100 mg of silver per 100 $cm^2$ of the support.

The following examples are given in order to illustrate the invention in greater detail without limiting the same. Unless otherwise indicated all parts, percents, ratios and the like are by weight.

EXAMPLE

A silver chloroiodobromide emulsion having an iodide content of 0.25 mol% and a bromide content of 16.5 mol% was obtained by precipitating silver halide grains by the double jet method and subjecting the emulsion to a physical ripening and a desalting treatment as described in U.S. Pat. No. 3,622,318. The average diameter of the silver halide grains contained in this emulsion was 0.4 micron. This emulsion contained 1.18 mol of silver halide per 1 kg of the emulsion. 1 kg of the emulsion was taken in a pot, heated in a thermostat at 50° C and dissolved. Predetermined amounts as shown in Table 1 of methanol solutions of the sensitizing dyes of the invention and the comparative dye shown below respectively were added and mixed with stirring at 40° C. 10 ml of a 0.1% by weight aqueous solution of 4-hydroxy-6-methyl-1,3, 3a, 7-tetrazaindene, 10 ml of a 1% by weight aqueous solution of 1-hydroxy-3,5-dichlorotriazine sodium salt and 10 ml of a 1% by weight aqueous solution of sodium dodecylbenzenesulfonate were added and stirred. The finished emulsion was coated onto a cellulose triacetate film base to provide a film thickness of 5 microns on a dry basis, thus obtaining a sample of a light-sensitive material.

The resulting sample was cut into strips. One of the strips was subjected to optical wedge exposure using an actinometer with a light source of a color temperature of 5400° K through a green filter (Wratten -58). The other was exposed to obtain a spectrogram using a diffraction grating type spectrograph with a tungsten light source of 2666° K. Using a developer (FD-3) having the following composition, the sample was developed at 20° C for 2 minutes, stopped, fixed and washed with water to obtain a strip having a black-and-white image, which was then subjected to density measurement using a densitometer of the S-type manufactured by the Fuji Photo & Film Co. to obtain a green-sensitive filter sensitivity ($S_G$) and fog. The standard point of the optical density to determine the sensitivity was (fog + 0.20).

| Composition of Developer (FD-3) | |
|---|---|
| Water | 500 ml |
| Metol | 2 g |
| Sodium Sulfite | 40 g |
| Hydroquinone | 4 g |
| Sodium Carbonate Monohydrate | 8 g |
| Potassium Bromide | 1 g |
| Water | to 1000 ml |

At the time of use, an equal volume of water was added to the developer.

The results obtained are shown in Table 1 as relative values.

Table 1

Figure 2:
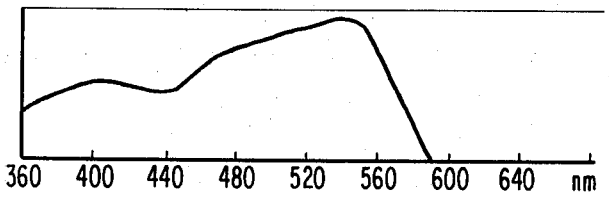
Figure 3:
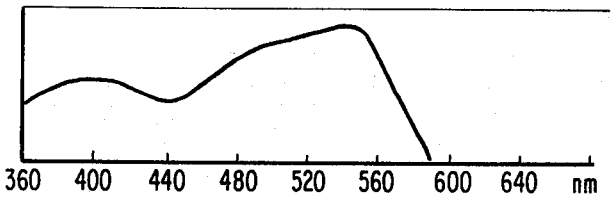
Figure 4:
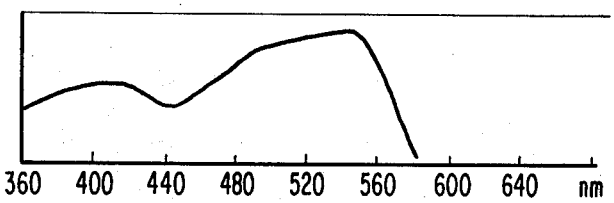

| Dye and Amount $\times 10^{-5}$ mol/kg Emulsion | | $S_G$ | Fog | Sensitization Maximum (nm) | Spectrogram |
|---|---|---|---|---|---|
| ( 1) | 32 | 240 | 0.05 | 545 | |
| ( 2) | 16 | 300 | 0.05 | 545 | Figure 2 |
| ( 6) | 16 | 300 | 0.05 | 550 | Figure 1 |
| ( 7) | 8 | 200 | 0.04 | 545 | |
| ( 8) | 8 | 182 | 0.04 | 545 | |
| ( 9) | 8 | 264 | 0.05 | 565 | |
| (15) | 8 | 170 | 0.05 | 545 | Figure 3 |
| (16) | 8 | 136 | 0.05 | 545 | Figure 4 |
| (20) | 16 | 254 | 0.04 | 545 | |
| (23) | 8 | 220 | 0.05 | 545 | |

Table 1-continued

Figure 5:
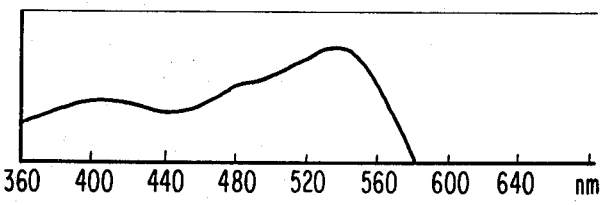
Figure 6:
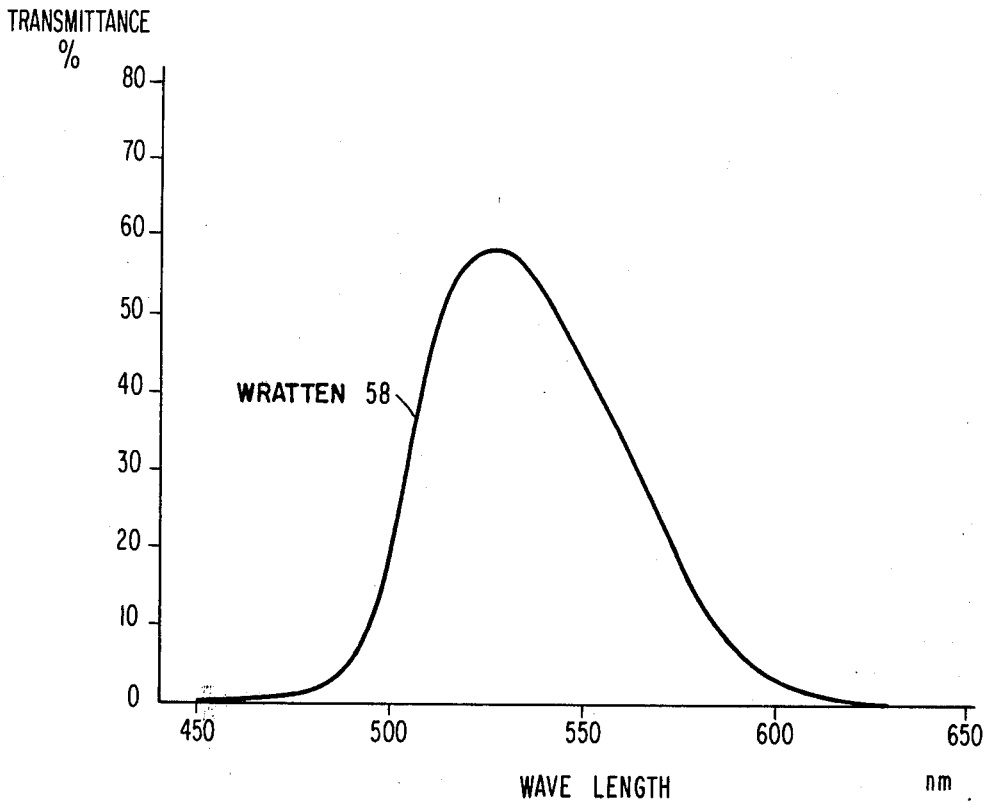
FIG. 6 shows the spectral transmittance curve of the Wratten 58 filter.

| Dye and Amount $\times 10^{-5}$ mol/kg Emulsion | $S_G$ | Fog | Sensitization Maximum (nm) | Spectrogram |
|---|---|---|---|---|
| Comparative Dye 16 | 100 | 0.05 | 540 | Figure 5 |

The values in Table 1 mean a specific sensitivity in the case of the optimum amount of each dye added, when the green sensitivity of the comparative dye was 100.

Comparison Sensitizing Dye

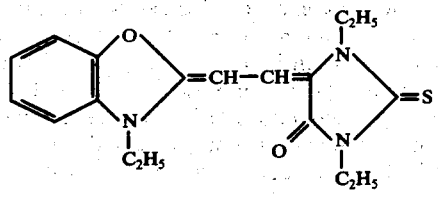

As is evident from the results in Table 1 and the spectrograms of FIG. 1 to FIG. 5, the sensitizing dye of the invention is superior to the comparative dye in green sensitivity.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion containing at least one sensitizing dye represented by the following general formula (I):

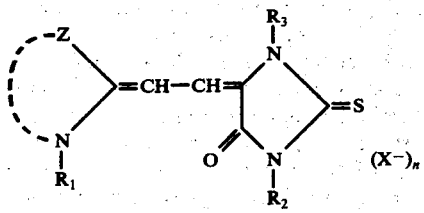

(I)

in which Z represents an atomic group necessary for forming a benzoxazole nucleus or a naphthoxazole nucleus; $R_1$ represents a member selected from the group consisting of an unsubstituted alkyl group; an alkyl group substituted with a hydroxy group, an alkoxy group, an acyloxy group, a carboxy group, an alkoxycarbonyl group, a sulfo group, or an aryl group; or an allyl group; $R_2$ represents an alkyl group, an allyl group or an aryl group; $R_3$ represents an N-(N,N-dialkylaminoalkyl)carbamoylalkyl group, an N-(N,N-trialkylammoniumalkyl)carbamoylalkyl group or an N,N,N-trialkylammoniumalkyl group, with $R_2$ being a phenyl group where $R_3$ is an alkoxycarbonylalkyl group; X represents an acid anion; and $n$ represents 0 or 1.

2. The silver halide photographic emulsion of claim 1, wherein $R_3$ represents an N-(N,N-dialkylaminoalkyl)-carbamoylalkyl group.

3. The silver halide photographic emulsion of claim 1, wherein $R_3$ represents an N-(N,N,N-trialkylammoniumalkyl)carbamoylalkyl group.

4. The silver halide photographic emulsion of claim 1, wherein $R_3$ represents an N,N,N-trialkylammoniumalkyl group.

5. The silver halide photographic emulsion of claim 1, wherein Z is halogen-, alkyl-, alkoxy-, hydroxy-, trifluoromethyl-, alkoxycarbonyl-, acetyl-, or phenyl- substituted benzoxazole, and an $\alpha$-naphthoxazole, a $\beta$, $\beta$-naphthoxazole or a $\beta$-naphthoxazole nucleus.

6. The silver halide photographic emulsion of claim 1, wherein Z is 5-fluorobenzoxazole, 5-chlorobenzoxazole, 5-chlorobenzoxazole, 5-bromobenzoxazole, 5-methylbenzoxazole, 5-methoxybenzoxazole, 5-hydroxybenzoxazole, 5-trifluoromethylbenzoxazole, 5-methoxycarbonylbenzoxazole, 5-acetylbenzoxazole, 5-phenylbenzoxazole, 6-methylbenzoxazole, 6-methoxybenzoxazole, 6-hydroxybenzoxazole, 5,6-dimethylbenzoxazole, or 5-chloro-6-methylbenzoxazole.

7. The silver halide photographic emulsion of claim 1, wherein said silver halide is silver chloride, silver bromide, silver iodide, silver chlorobromide, silver bromoiodide, silver chloroiodide, or silver chlorobromoiodide.

8. The silver halide photographic emulsion of claim 1, wherein the grains of said silver halide have an average diameter ranging from about 0.04 to 2 microns.

9. The silver halide photographic emulsion of claim 1, wherein said silver halide emulsion contains at least one of a chemical sensitizer, an optical sensitizer, a hardener, an antifoggant, a stabilizer, a coating aid, and a color coupler.

10. The silver halide photographic emulsion of claim 1, wherein said at least one sensitizing dye has the formula:

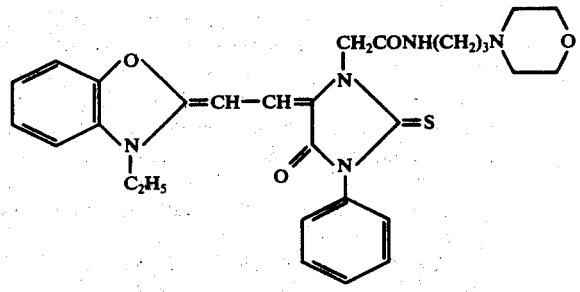

11. The silver halide photographic emulsion of claim 1, wherein said at least one sensitizing dye has the formula:

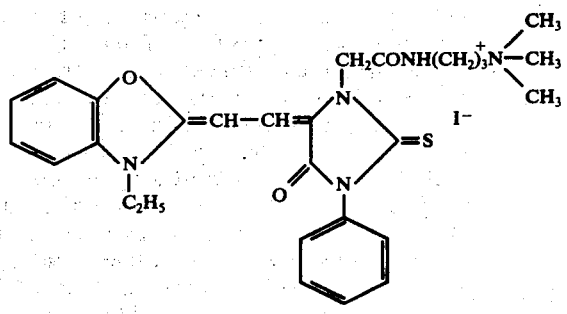

12. The silver halide photographic emulsion of claim 1, wherein $R_3$ is an N-(3-(N,N-dimethylamino)propyl)-carbamoylmethyl, N-(2-(N,N-diethylamino)ethyl)carbamoylmethyl, N-(3-(morpholino)-propyl)-carbamoylmethyl, N-(3-piperidino)propyl)carbamoylmethyl), N-(3-(N,N,N-triethylammonium)propyl)carbamoylmethyl, N-(3-methylmorpholino)-propyl)-carbamoylmethyl, N-(3-(N-methylpiperidino)propyl)carbamoylmethyl), or an N,N,N-trialkylammoniumalkyl group.

13. The silver halide photographic emulsion of claim 1, wherein said at least one sensitizing dye is used in an amount of from about $5 \times 10^{-3}$ mol to $1 \times 10^{-6}$ mol of said at least one sensitizing dye per 1 mol of silver.

14. A silver halide photographic element comprising a support having thereon a layer of the silver halide photographic emulsion of claim 1.

* * * * *